US009080540B2

(12) United States Patent
Peters et al.

(10) Patent No.: US 9,080,540 B2
(45) Date of Patent: Jul. 14, 2015

(54) ENGINE WITH INJECTOR MOUNTING AND COOLING ARRANGEMENT

(75) Inventors: Lester L. Peters, Columbus, IN (US); John Toksoy, Westport, IN (US); Laszlo Tikk, Westport, IN (US)

(73) Assignee: Cummins Inc., Columbus, IN (US)

( * ) Notice: Subject to any disclaimer, the term of this patent is extended or adjusted under 35 U.S.C. 154(b) by 852 days.

(21) Appl. No.: 13/207,986

(22) Filed: Aug. 11, 2011

(65) Prior Publication Data

US 2012/0037124 A1 Feb. 16, 2012

Related U.S. Application Data

(60) Provisional application No. 61/372,701, filed on Aug. 11, 2010.

(51) Int. Cl.
*F02M 61/14* (2006.01)
*F01P 3/16* (2006.01)
*F02M 53/04* (2006.01)

(52) U.S. Cl.
CPC *F02M 61/14* (2013.01); *F01P 3/16* (2013.01); *F02M 53/043* (2013.01)

(58) Field of Classification Search
CPC .. F02M 2200/85; F02M 53/04; F02M 53/043
USPC ..... 123/41.31, 41.82 R, 41.82 A, 470, 509
See application file for complete search history.

(56) References Cited

U.S. PATENT DOCUMENTS 2,777,431 A * 1/1957 Meurer ..... 123/470
3,038,456 A * 6/1962 Dreisin ..... 123/470
3,125,078 A * 3/1964 Reiners ..... 123/468
3,334,617 A * 8/1967 Palkowsky ..... 123/470
3,353,521 A 11/1967 Ley
3,353,522 A * 11/1967 Ley ..... 123/41.31
3,889,644 A 6/1975 Moore
3,945,353 A * 3/1976 Dreisin ..... 123/41.22
4,057,190 A 11/1977 Kiwior et al.

(Continued)

FOREIGN PATENT DOCUMENTS

GB 719952 12/1954

OTHER PUBLICATIONS

Notification of Transmittal of the International Search Report and the Written Opinion of the International Searching Authority, or the Declaration, dated Jan. 13, 2012; International Application No. PCT/JP2011/047423.

(Continued)

*Primary Examiner* — Hieu T Vo
*Assistant Examiner* — Arnold Castro
(74) *Attorney, Agent, or Firm* — Faegre Baker Daniels LLP

(57) ABSTRACT

An internal combustion engine is provided including an injector having an injector body including a nozzle assembly having an annular outer surface. A cylinder head includes an injector mounting bore to receive the injector, and a lower sealing portion. The engine also includes an engine coolant passage formed in the cylinder head to receive engine coolant to remove heat from the cylinder head. The engine coolant passage opens into, and is fluidly connected to, the mounting bore to cause coolant in the coolant passage to contact the annular outer surface of the nozzle assembly. A lower seal is positioned between the lower sealing portion and the nozzle assembly to form a fluid seal.

18 Claims, 3 Drawing Sheets

(56) References Cited

U.S. PATENT DOCUMENTS

| | | | | |
|---|---|---|---|---|
| 4,066,213 | A * | 1/1978 | Stampe | 239/533.3 |
| 4,625,682 | A | 12/1986 | Dietrich et al. | |
| 4,770,138 | A | 9/1988 | Onishi | |
| 5,024,193 | A * | 6/1991 | Graze, Jr. | 123/259 |
| 5,345,913 | A | 9/1994 | Belshaw et al. | |
| 5,535,723 | A | 7/1996 | Gibson et al. | |
| 5,577,386 | A | 11/1996 | Alary et al. | |
| 5,784,783 | A * | 7/1998 | Carpenter | 29/888.011 |
| 5,860,394 | A | 1/1999 | Saito et al. | |
| 5,899,190 | A * | 5/1999 | Nakagomi et al. | 123/470 |
| 5,983,843 | A | 11/1999 | Suzuki et al. | |
| 6,053,432 | A * | 4/2000 | Stevens | 239/533.2 |
| 6,112,722 | A * | 9/2000 | Barnhart et al. | 123/470 |
| 6,116,218 | A * | 9/2000 | Sato et al. | 123/470 |
| 6,119,658 | A * | 9/2000 | Jehle et al. | 123/470 |
| 6,276,611 | B1 | 8/2001 | Brooker et al. | |
| 6,279,516 | B1 * | 8/2001 | Haugen et al. | 123/41.82 R |
| 6,481,421 | B1 * | 11/2002 | Reiter | 123/470 |
| 6,612,272 | B2 | 9/2003 | Kato et al. | |
| 6,837,221 | B2 | 1/2005 | Crofts et al. | |
| 6,866,026 | B2 * | 3/2005 | Mickelson | 123/470 |
| 6,892,707 | B2 * | 5/2005 | Reiter et al. | 123/470 |
| 7,021,558 | B2 | 4/2006 | Chenanda et al. | |
| 7,028,918 | B2 | 4/2006 | Buchanan et al. | |
| 7,150,416 | B2 | 12/2006 | Martin et al. | |
| 7,207,321 | B2 | 4/2007 | Vadimovitch et al. | |
| 7,334,741 | B2 | 2/2008 | Benson et al. | |
| 7,415,946 | B2 | 8/2008 | Merchant et al. | |
| 8,230,838 | B2 * | 7/2012 | Clark et al. | 123/470 |
| 2004/0060544 | A1 * | 4/2004 | Reiter et al. | 123/470 |
| 2008/0271713 | A1 * | 11/2008 | Morris | 123/470 |
| 2011/0067653 | A1 * | 3/2011 | Clark et al. | 123/41.31 |

OTHER PUBLICATIONS

International Search Report in PCT/US20111047423, mailed Jan. 13, 2012, 2 pages.

International Preliminary Report on Patentability in PCT1US2011/047423, issued Feb. 12, 2013, 6 pages.

* cited by examiner

ENGINE WITH INJECTOR MOUNTING AND COOLING ARRANGEMENT

TECHNICAL FIELD

This disclosure relates to fuel injectors for injecting high pressure fuel into an engine cylinder, and engines having cooling arrangements for cooling the injectors during operation.

BACKGROUND

Internal combustion engines are typically each include an engine body, e.g. engine block and head, that require cooling by an engine coolant to remove excessive heat. Many engines also include fuel injectors mounted in respective injector mounting bores and including nozzle assemblies used to inject fuel into the engine cylinders for combustion. The fuel injectors, including the nozzle assemblies, are exposed to very high temperatures and thus require cooling. The physical separation of engine coolant and injection fuel in the vicinity of the injector in the engine cylinder head is challenging from a manufacturing/assembly perspective and may add to reliability issues.

SUMMARY

This disclosure provides an internal combustion engine, comprising an injector including an injector retainer having an outer surface and a nozzle assembly positioned in the injector retainer. A cylinder head includes an injector mounting bore to receive the injector, an upper sealing portion, and a lower sealing portion. An upper seal is positioned between the upper sealing portion and the injector retainer to form a fluid seal. An engine coolant passage is formed in the cylinder head to receive engine coolant to remove heat from the cylinder head. The engine coolant passage opens into, and fluidly connected to, the mounting bore to cause coolant in the coolant passage to contact the outer surface of the injector retainer. A lower seal is positioned between the lower sealing portion and the injector retainer to form a fluid seal.

This disclosure is also directed to an internal combustion engine, comprising an injector including an injector body containing fuel for injection into the engine, wherein the injector body including an injector support and a nozzle assembly positioned in the injector support. The injector support includes an annular outer surface and an annular inner surface facing the nozzle assembly. A cylinder head includes an injector mounting bore to receive the injector and a lower sealing portion. An engine coolant passage is formed in the cylinder head to receive engine coolant to remove heat from the cylinder head. The engine coolant passage opens into, and fluidly connected to, the mounting bore to cause coolant in the coolant passage to contact the annular outer surface of the injector support.

Advantages and features of the embodiments of this disclosure will become more apparent from the following detailed description of exemplary embodiments when viewed in conjunction with the accompanying drawings.

DETAILED DESCRIPTION

Applicant has recognized that conventional methods of fuel-to-coolant separation around the injector nozzle tend to reduce the effectiveness of heat transfer from the nozzle to the coolant, resulting in elevated nozzle tip temperatures in operation. Reduced nozzle temperature is desirable for reducing spray hole coking, nozzle carboning and nozzle cavitation. By allowing the engine coolant to be in direct physical contact with the injector nozzle assembly, the arrangements of this disclosure provide enhanced cooling of the nozzle assembly thereby increasing reliability while also simplifying the manufacturing process. The arrangements of the present disclosure also avoid the need for a feature or an additional part in the engine cylinder head that separates the coolant and fuel around the injector nozzle.

Figure 1:
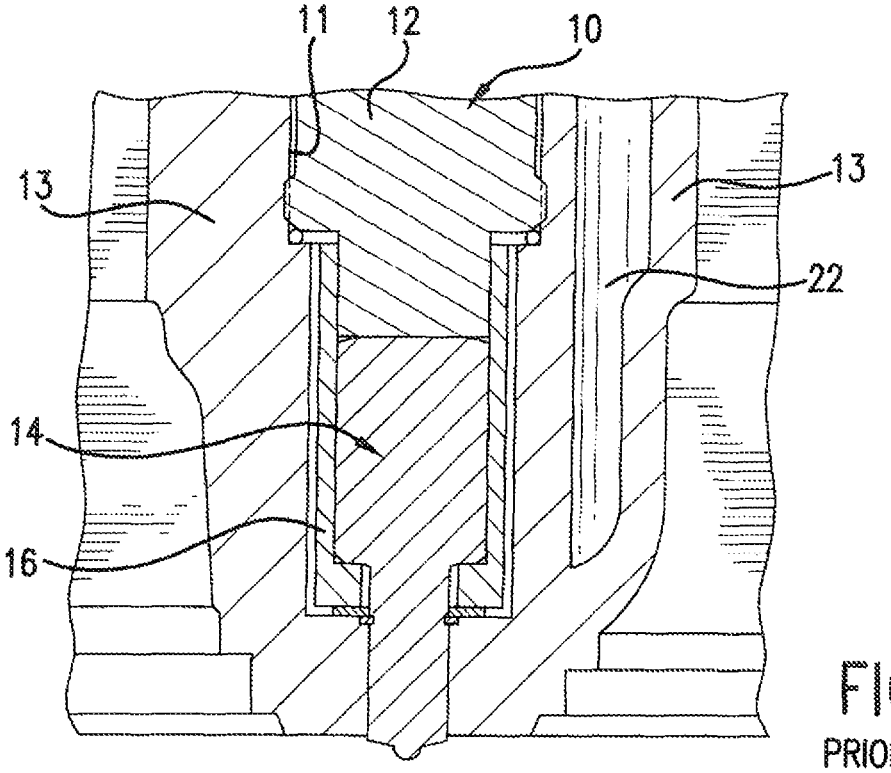
FIG. 1 PRIOR ART
FIG. 1 is a partial cross-sectional view of the lower portion of a prior art injector showing a cast-in portion of the cylinder head surrounding the injector and a cast-in engine coolant passage spaced and separate from the injector.

FIG. 1 shows an example of conventional injector assembly including an injector body 10 positioned in a mounting bore 11 formed in an engine body, i.e. cylinder head 13. The injector body 10 includes a barrel 12 and an injector nozzle assembly 14 including a retainer 16 used to connect the injector nozzle assembly 14 to the barrel 12. A cooling passage 22 is cast into the cylinder head 13 surrounding the nozzle assembly 14 between the mounting bore and an exhaust port. This design allows engine coolant to flow in the vicinity of the nozzle assembly but separated from the injector by the engine body/cylinder head and thus the coolant does not directly contact with the outer surface of the injector body, i.e. retainer 16.

Figure 2:
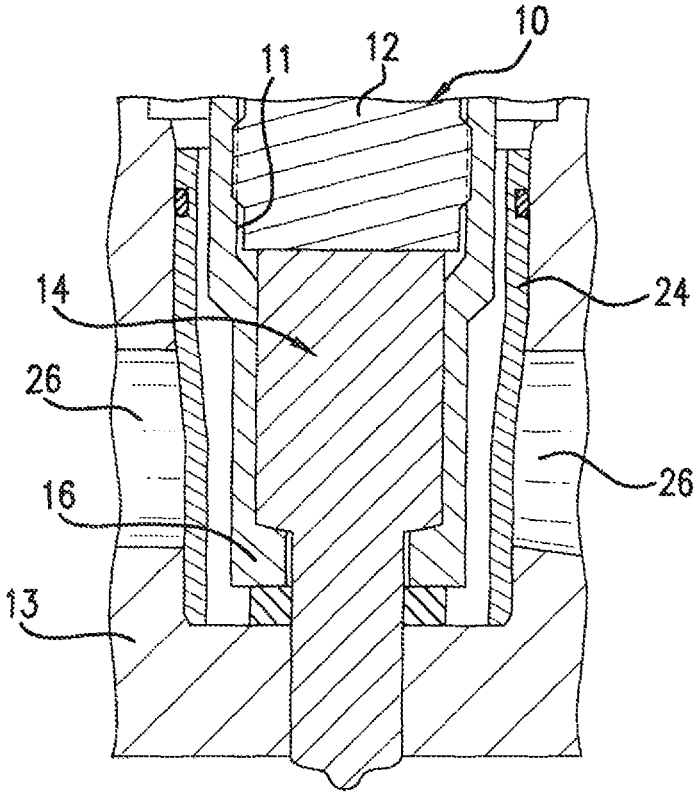
FIG. 2 PRIOR ART
FIG. 2 is a partial cross-sectional view of the lower portion of a prior art injector showing a pressed-in sleeve for receiving the injector and blocking coolant from contact with the injector.

FIG. 2 shows an example of another conventional injector assembly similar to the conventional assembly of FIG. 1 except a press-in sleeve 24, separate from the injector, is inserted into the mounting bore prior to insertion of the injector. The inner end of sleeve 24 forms an interference fit with the inner annular wall of the cylinder head forming the mounting bore to form a fluid seal while the outer end of sleeve 24 includes a seal for engaging the cylinder head. In this manner, a coolant passage 26, formed in the cylinder head, is fluidly separated from, and does not open into, the space immediately surrounding nozzle assembly 14. Thus, the engine coolant is permitted to contact the outside of the sleeve 24 which is positioned a spaced distance from the injector but does not permit coolant to contact nozzle assembly 14, i.e., retainer, thereby permitting fuel on the inside of the press-in sleeve between the retainer and the sleeve. However, this press-in sleeve may develop leaks and result in fuel-to-coolant contaminations. Neither example shown in FIG. 1 or FIG. 2 allows effective cooling of the injector nozzle by the engine coolant, since the heat transfer paths from the nozzle to the engine coolant are indirect and inefficient.

Figure 3:
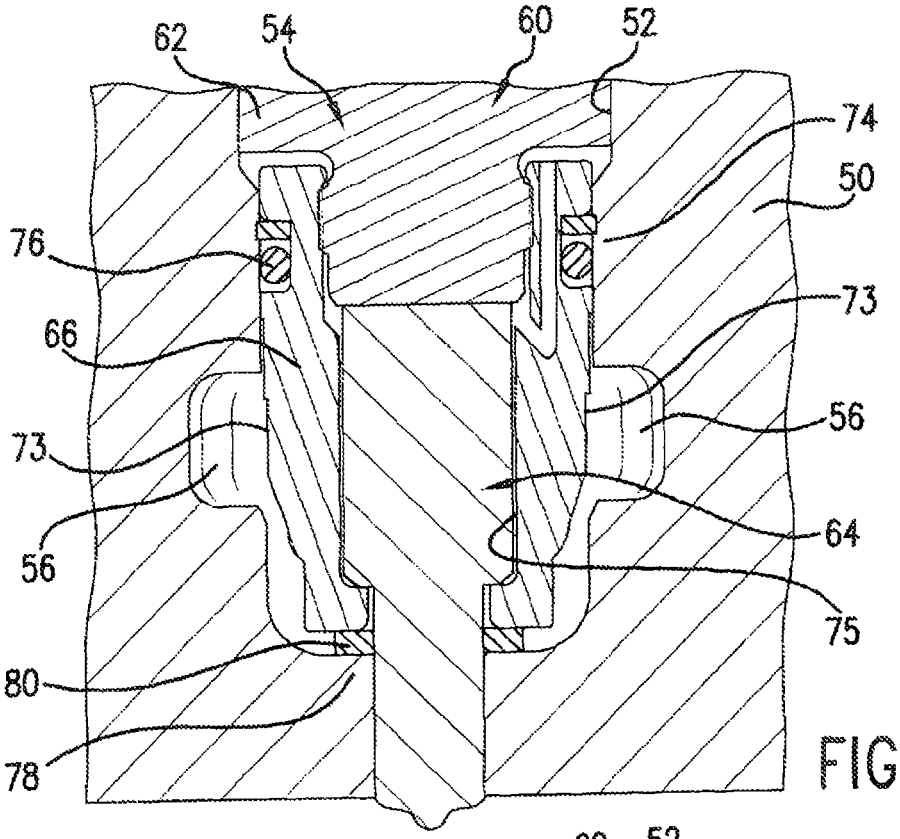
FIG. 3 is a partial cross-sectional view of the lower portion of the injector and injector mounting and cooling arrangement of an exemplary embodiment of the present disclosure.
Figure 4:
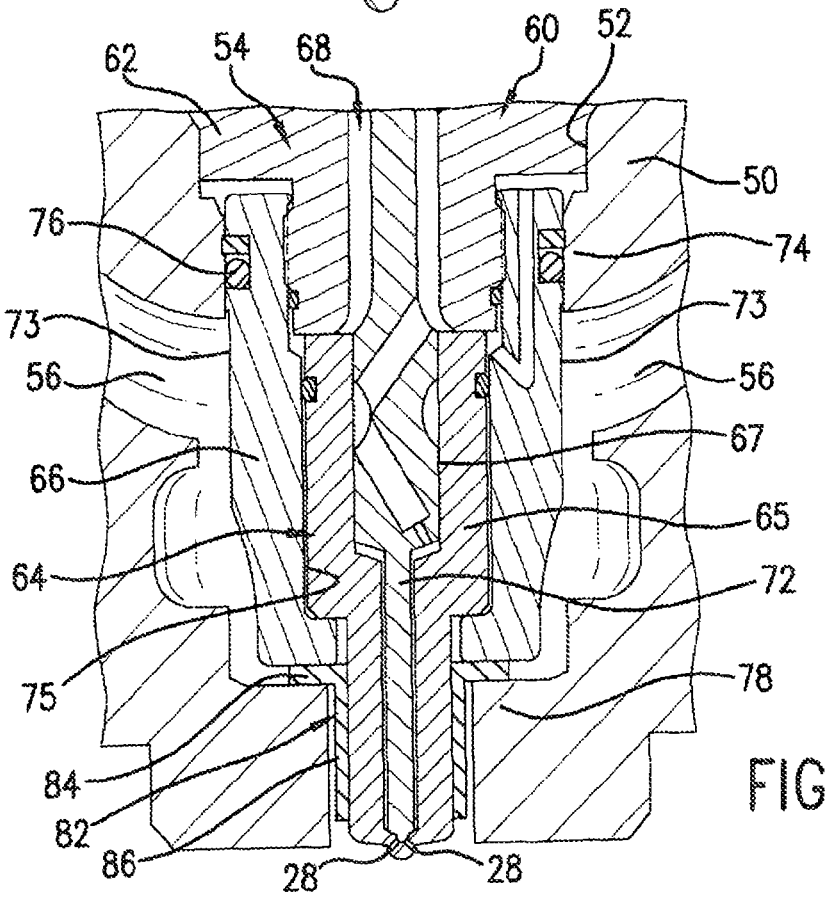
FIG. 4 is a partial cross-sectional view of the lower portion of the injector and injector mounting and cooling arrangement of another exemplary embodiment of the present disclosure.

FIGS. 3 and 4 show examples of exemplary embodiments of the arrangement of the present disclosure including an engine body 50, i.e. cylinder head, having a mounting bore 52 formed therein, and a fuel injector assembly 54 positioned in mounting bore 52. Like reference numerals will be used for the same or similar features in FIGS. 3 and 4. A coolant passage 56 is formed in the cylinder head 50 and preferably extends annularly around mounting bore 52 so as to open into and fluidly connect to mounting bore 52. Coolant passage 56 extends transversely outwardly from mounting bore 52 and axially along mounting bore 52 to form a volume for receiving engine coolant and directing the coolant around fuel injector assembly 54.

In the exemplary embodiment, fuel injector assembly 54 includes an injector body 60 including an injector barrel 62 and a nozzle assembly 64 including a retainer 66 secured to some other portion of the injector body. In the exemplary embodiment, retainer 66 threadably engages barrel 62 to secure nozzle assembly 64 and barrel 62 in a compressive abutting relationship by simple relative rotation of retainer 66 and barrel 62. Although only FIG. 4 shows details of the nozzle assembly 64 and barrel 62, the same features may be present in the embodiment of FIG. 3. In the exemplary embodiment of FIG. 4, injector assembly 54 further includes a fuel transfer circuit 68 for delivering fuel through the injector cavity and to a plurality of injector orifices 28 formed in nozzle housing 64 for injection into a combustion chamber of an engine (not shown). Nozzle assembly 64 includes a nozzle housing 65, a central bore 67, and a nozzle valve element 72 reciprocally mounted in the injector cavity and extending into central bore 67 for opening and closing injector orifices 28 thereby controlling the flow of injection fuel into an engine combustion chamber. Specifically, nozzle valve element 72 is movable between an open position in which fuel may flow through injector orifices 28 into the combustion chamber and a closed position in which an inner end of nozzle valve element 72 is positioned in sealing abutment against a valve seat formed on nozzle housing 64 so as to block fuel flow through injector orifices 28.

The nozzle assembly 64, i.e., injector retainer 66, is in direct contact with the engine coolant on one side (outer surface 73) and in direct contact with at least one of the nozzle assembly and fuel on the other side (inner surface 75), therefore providing direct heat transfer path from the nozzle assembly 64 to the engine coolant in coolant passage 56. Also, the outer distal end of the nozzle housing, positioned adjacent barrel 62, is also positioned axially along the injector's longitudinal axis between the upper seal 76 and the lower seal 80, 82 thereby providing coolant over a substantial portion of the nozzle assembly.

This sleeveless injector mounting and cooling arrangement avoids the need for the cost and challenges of a pressed-in sleeve and/or a cast-in cooling passage surrounding and spaced from the injector mounting bore. The cylinder head 50 of the engine includes the engine coolant passage 56 extending annularly completely around, and opening into, injector mounting bore 52 also formed in the cylinder head. The assembled fuel injector assembly 54, with the injector retainer 66 of nozzle assembly 64 attached to (threadably engaging) the injector barrel 62 to connect the barrel to the nozzle assembly, is inserted into the injector mounting bore 52. Cylinder head 50, forming a portion of the mounting bore 52, includes an upper sealing portion 74 sized relative to the outer surface 73 of the nozzle assembly 64, i.e. retainer 66, to form a close fit interface. An upper seal 76 is positioned at this close fit interface to create a fluid seal. The cylinder head 50 also includes a lower sealing portion, i.e., annular land, 78 against which an axial injector mounting force, created by an injector mounting system not shown, is applied via nozzle assembly 64, i.e., retainer 66. As shown in FIG. 3, a lower seal 80 is mounted between a lower distal end portion of retainer 66 and annular land 78 to fluidly seal the lower end of mounting bore 52. Engine coolant passage 56 is a continuation of the mounting bore and extends radially outwardly so that no portion of the cylinder head prevents coolant from flowing over a substantial portion of the outer surface of the nozzle assembly, i.e. retainer. Substantially the entire outer surface of the nozzle assembly between the upper and lower seals, i.e. at least 80%, is exposed and in contact with coolant thereby enhancing injector nozzle assembly cooling. The coolant passage and mounting bore are shaped to permit coolant to contact an outer annular portion of lower seal 80 and a transverse distal end surface of retainer 66 to further enhance cooling. Thus the mounting bore is sealed at a first location and at a second location along the retainer with coolant impinging the retainer in the area between the seals adjacent the injector nozzle assembly.

The embodiment of FIG. 4 differs from the embodiment of FIG. 3 in that the cross-section is taken along a different plane thereby showing a greater portion of the coolant passages, and the lower seal 80 is replaced by an integral seal and cooling sleeve 82 having a flange seal portion 84 and an annular cooling sleeve portion 86 extending along the inner end of portion of nozzle housing 65. The flange seal portion 84 is positioned between the retainer 66 and the cylinder head to create a seal.

In an alternative embodiment, the retainer may be formed integrally as a single piece component with nozzle housing 65. Also the retainer may be axially shorter than disclosed, whether formed integrally or as a separate component, so that coolant contacts the outer annular surface of nozzle housing 65 directly while lower seal 80 is positioned between nozzle housing 65 and the cylinder head.

Although the injector mounting and cooling arrangement of the present disclosure is described herein in connection with the closed nozzle injector assembly shown in FIG. 4 having a particular set of fuel passages to deliver fuel to the injector orifices and a particular shaped nozzle valve element, the present arrangement may be used with any type of injector having a nozzle assembly exposed to high temperatures and mounted in a mounting bore of an engine body. The injector may be operated by any type of actuator, such as solenoid, piezoelectric, etc, and may be direct, servo or otherwise actuated. The nozzle valve element may be positioned entirely within the nozzle assembly or extend outwardly into other portions of the injector. For example, typical injectors may include those disclosed in U.S. Pat. Nos. 6,837,221 and 7,334,741, the entire contents of both being hereby incorporated by reference.

Figure 5:
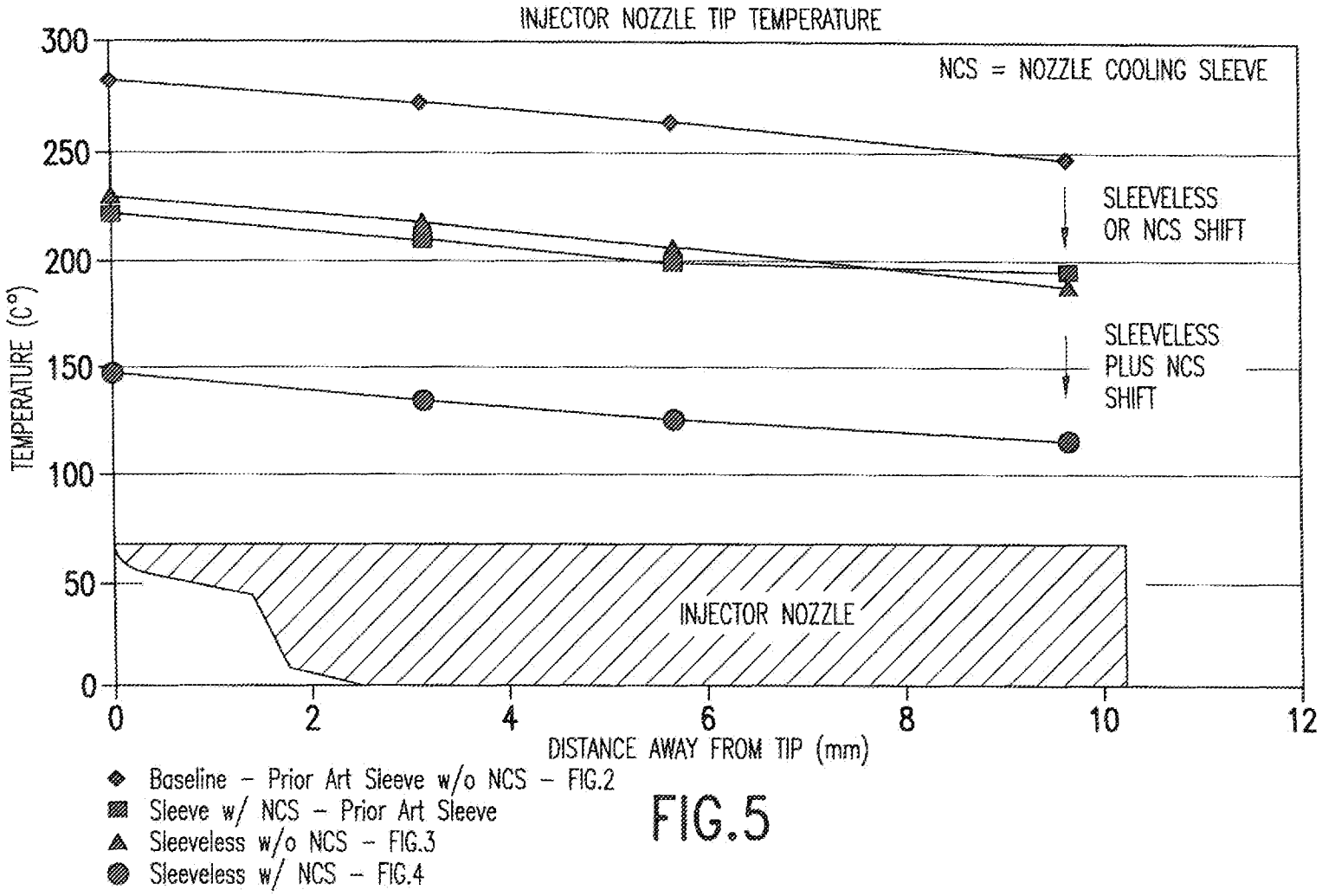
FIG. 5 is a graph of temperature versus distance away from the nozzle tip showing nozzle tip temperatures.

Finite-element thermal analyses show that the nozzle tip temperature can be lowered by 60-70° C. in comparison with a conventional sleeved configuration of FIG. 1 and FIG. 2, in a diesel engine application. The elimination of a fluid partition (as shown in FIG. 1) or a sleeve (as shown in FIG. 2) can also reduce the cost of the engine. Specifically, referring to FIG. 5, thermal analysis shows the sleeveless injector arrangement of the present disclosure provides enhanced cooling compared to the conventional designs of FIGS. 1 and 2. Moreover, when used in combination with the nozzle cooling sleeve as shown in FIG. 4, even further temperature reduction is possible.

The engine power density is on an increasing trend, with legislative and consumer demands. Thermal loading on engine components, such as fuel injectors, generally increases with the engine power density. The injector nozzle tip temperature may increase beyond material limits, and high tip temperatures may bring undesirable effects such as carboning or varnishing. By effectively controlling the nozzle temperature, embodiments consistent with the present disclosure essentially eliminate the limitation placed on the engine power density by the nozzle temperature, resulting in an improved engine product.

While various embodiments in accordance with the present disclosure have been shown and described, it is understood that the disclosure is not limited thereto. The present disclosure may be changed, modified and further applied by those skilled in the art.

We claim:

1. An internal combustion engine, comprising:

an injector including a nozzle assembly having an outer surface;

a cylinder head including an injector mounting bore to receive the injector, an upper sealing portion, and a lower sealing portion;

an upper seal positioned between said upper sealing portion and said nozzle assembly to form a fluid seal;

an engine coolant passage formed in said cylinder head to receive engine coolant to remove heat from said cylinder head, said engine coolant passage opening into, and fluidly connected to, said mounting bore to cause coolant in said coolant passage to contact said outer surface of said nozzle assembly; and a lower seal positioned between said lower sealing portion and said nozzle assembly to form a fluid seal, said lower seal including a flange and a annular cooling sleeve extending from the flange to surround a portion of the nozzle assembly, said flange positioned between the nozzle assembly and the cylinder head to create the fluid seal and having a surface in contact with said coolant.

2. The engine of claim 1, wherein said nozzle assembly includes a nozzle housing including an inner distal end and an outer distal end, said outer distal end of said nozzle housing positioned between said upper seal and said lower seal.

3. The engine of claim 1, wherein said flange of said lower seal is configured to remove heat from the annular cooling sleeve to cool a nozzle tip of said nozzle assembly by at least 50 degrees Farenheit relative to a lower seal without said annular cooling sleeve.

4. The engine of claim 1, wherein said outer surface has an axial extent between said upper seal and said lower seal, wherein at least 80% of said axial extent is exposed to said coolant passage for contact by the engine coolant.

5. The engine of claim 1, wherein said nozzle assembly includes a lower distal end portion positioned adjacent said lower seal, said lower distal end portion being in contact with engine coolant.

6. The engine of claim 5, wherein nozzle assembly includes a retainer and a nozzle housing positioned in said retainer, said lower distal end portion including a transverse distal end surface extending transverse to a longitudinal axis of the injector and defining a distal end of the retainer, a portion of said transverse distal end surface in contact with the engine coolant.

7. The engine of claim 1, wherein said upper sealing portion is sized to form a close fit with said nozzle assembly.

8. The engine of claim 1, wherein said nozzle assembly includes a retainer, a nozzle housing positioned in said retainer, a nozzle bore formed in the housing, and a nozzle valve element positioned in said nozzle bore, said retainer engaging said nozzle housing to retain said nozzle housing in position.

9. The engine of claim 1, wherein the injector includes a barrel, said nozzle assembly connected to said barrel to secure said nozzle assembly to said barrel.

10. An internal combustion engine, comprising:

an injector including an injector body containing fuel for injection into the engine, the injector body including a barrel and a nozzle assembly positioned adjacent said barrel, said nozzle assembly including an annular outer surface and an annular inner surface;

a cylinder head including an injector mounting bore to receive the injector, and a lower sealing portion;

an engine coolant passage formed in said cylinder head to receive engine coolant to remove heat from said cylinder head, said engine coolant passage opening into, and fluidly connected to, said mounting bore to cause coolant in said coolant passage to contact said annular outer surface of said nozzle assembly; and a lower seal positioned between said lower sealing portion and said nozzle assembly to form a fluid seal, said lower seal including a surface in contact with said coolant, said lower seal including a flange and an annular cooling sleeve extending from the flange to surround a portion of the nozzle assembly, said flange positioned between the nozzle assembly and the cylinder head to create the fluid seal and having said surface in contact with said coolant.

11. The engine of claim 10, further including an upper seal, wherein said nozzle assembly includes a nozzle housing including an inner distal end and an outer distal end, said outer distal end of said nozzle housing positioned between said upper seal and said lower seal.

12. The engine of claim 10, wherein said flange of said lower seal is configured to remove heat from the annular cooling sleeve to cool a nozzle tip of said nozzle assembly by at least 50 degrees Farenheit relative to a lower seal without said annular cooling sleeve.

13. The engine of claim 10, wherein said nozzle assembly includes a lower distal end portion positioned adjacent said lower seal, said lower distal end portion being in contact with engine coolant.

14. The engine of claim 13, wherein said lower distal end portion includes a transverse distal end surface extending transverse to a longitudinal axis of the injector and defining a distal end of the nozzle assembly, a portion of said transverse distal end surface in contact with the engine coolant.

15. The engine of claim 10, wherein the cylinder head includes an upper sealing portion sized to form a close fit with said injector.

16. The engine of claim 10, wherein said nozzle assembly includes a retainer, a nozzle housing positioned in said retainer, a nozzle bore formed in the nozzle housing, and a nozzle valve element positioned in said nozzle bore, said retainer engaging said nozzle housing to retain said nozzle housing in position.

17. The engine of claim 10, wherein at least 80% of said annular outer surface is exposed to said engine coolant passage for contact by the engine coolant.

18. The engine of claim 11, wherein said annular outer surface has an axial extent between said upper seal and said lower seal, wherein at least 80% of said axial extent is exposed to said engine coolant passage for contact by the engine coolant.

* * * * *